United States Patent [19]

Sato et al.

[11] 4,213,843

[45] Jul. 22, 1980

[54] ELECTROLYSIS ELECTRODES AND METHOD OF MAKING SAME

[75] Inventors: Hideo Sato; Takayuki Shimamune, both of Ichihara, Japan

[73] Assignee: Permelec Electrode Ltd., Ichihara, Japan

[21] Appl. No.: 19,208

[22] Filed: Mar. 9, 1979

[30] Foreign Application Priority Data

Mar. 24, 1978 [JP] Japan ..... 53/3300878

[51] Int. Cl.[2] ..... C25B 11/08; C25B 11/10

[52] U.S. Cl. ..... 204/290 F; 427/376.4; 427/383.7

[58] Field of Search ..... 204/290 R, 290 F, 293, 204/290 G, 290 H; 427/376 C, 376 H, 383 C, 377

[56] References Cited

U.S. PATENT DOCUMENTS

| | | | |
|---|---|---|---|
| 3,793,164 | 2/1974 | Kolb | 204/290 F |
| 3,865,703 | 2/1975 | Schenker | 204/290 F |
| 3,875,043 | 4/1975 | Franks | 204/290 F |
| 3,917,518 | 11/1975 | Franks | 204/290 F |
| 3,926,751 | 12/1975 | De Nora | 204/290 F |
| 3,969,217 | 7/1976 | Bommaraju | 204/290 F |

*Primary Examiner*—T. M. Tufariello
*Attorney, Agent, or Firm*—Sughrue, Rothwell, Mion, Zinn and Macpeak

[57] ABSTRACT

An electrode for use in electrolysis of an aqueous solution of a metal halide such as an alkali metal or alkaline earth metal halide comprising:

(1) an electroconductive substrate, such as of titanium; and (2) a coating on the substrate, where the coating comprises:

(a) 5 to 75 mole percent of iridium oxide;

(b) 5 to 70 mole percent of at least one metal oxide selected from the group consisting of oxides of titanium, tantalum and niobium; and (c) 20 to 70 mole percent of at least one of a member selected from the group consisting of tin oxide and cobalt oxide, with the sum of the mole percent of the iridium oxide (a) plus the mole percent of the metal oxide (b) being at least 30 mole percent, and a method of making the same.

9 Claims, 2 Drawing Figures

ELECTROLYSIS ELECTRODES AND METHOD OF MAKING SAME

BACKGROUND OF THE INVENTION

1. Field Of The Invention

This invention relates to electrodes for use in electrolysis of aqueous solutions of metal halides, such as alkali metal or alkaline earth metal halides, and especially relates to electrodes suitable for use in electrolysis of dilute brine, such as sea water at low temperature, and also to a method of making the same.

2. Description Of The Prior Art

Up until the present, an electrolytic apparatus, which electrolyzes dilute brine, usually an aqueous solution with a halide concentration of about 15% by weight or less, such as sea water, and evolves chlorine gas at the anode side, has been used for the prevention of the adhesion of marine life to marine structures and for water treatment at swimming pools, waterworks and sewage treatment plants.

In these electrolytic processes using an electrolytic apparatus which has no diaphragm, chlorine gas is evolved at the anode side and hypochlorite ion is produced by reaction of chlorine and hydroxyl ion. The hypochlorite ion produced is useful for sterilization purposes and for bleaching, for instance. Because operation of such an electrolytic apparatus is continuous for a long time, desirably at good efficiency and in a stable manner, and is usually outdoors, the anodes used must have especially high durability and, at the same time, the characteristics of the electrode should be maintained.

Namely, in an electrolysis such as a sea water electrolysis where the electrolytic conditions differ from a chlorine-alkali metal hydroxide electrolysis in concentrated brine, e.g., brine containing about 20% by weight to a saturated amount of halide, the electrolytic conditions, such as the concentration and the temperature of the electrolyte, are not fixed and the concentration of sodium chloride is quite low, ordinarily about 3% by weight, and the temperature of the sea water goes below 20° C. Therefore, requirements such as sufficiently high chlorine evolution efficiency and durability must be met under these conditions. Heretofore, various kinds of electrodes for brine electrolysis with a coating of which the main components are platinum group metals, such as ruthenium, or oxides thereof, on an anti-corrosive substrate, such as titanium, are well known, for example, as disclosed in Japanese Patent Publication No. 3954/1973 (corresponding to U.S. Pat. No. 3,711,385), etc.

It can be said that these known electrodes described above are designed to evolve chlorine gas with good current efficiency, and efforts are made to achieve a low chlorine evolution potential and a large difference between oxygen and chlorine evolution potentials. These electrodes are considered sufficient for use in concentrated brine electrolysis at relatively high temperature, e.g., about 60° to 105° C., usually around 90° C., such as in chlorine-alkali metal hydroxide electrolysis, but they are not always advantageous for use in dilute brine electrolysis at low temperature, e.g., at below about 25° C., as in sea water electrolysis.

On the other hand, known electrodes for use in dilute brine electrolysis such as sea water electrolysis are described in Japanese Patent Applications Nos. (OPI) 58075/1977 and 13298/1975 (corresponding to U.S. Pat. No. 3,917,518) (the term Japanese Patent Application (OPI), as used herein, means a published but unexamined Japanese patent application).

Japanese Patent Application No. (OPI) 58075/1977 describes an electrode having a coating of which the principal component is palladium oxide on an electroconductive substrate. This electrode can be expected to have good chlorine evolution efficiency in electrolytic processes at relatively higher temperatures, but the corrosion resistance of this electrode is unsatisfactory at low temperatures, especially at lower than 20° C., and problems occur with this electrode since complicated procedures are involved in its manufacture because palladium metal must be completely absent from the coating of the electrode.

Japanese Patent Application No. (OPI) 13297/1975 discloses an electrode for use in a process of producing hypochlorite which has a coating of oxides of tin, antimony, a platinum group metal and a valve metal, such as titanium, on an electroconductive substrate. This electrode would appear to be useful in electrolyzing sea water at relatively low temperatures. However, antimony oxide is an essential component of the coating, and since antimony oxide vaporizes easily during the electrode coating procedure, the yield is not good. As a result, it is difficult to obtain an electrode of the desired composition in a reliable and stable manner.

SUMMARY OF THE INVENTION

An object of this invention is to solve the prior art problems described above.

Another object of this invention is to provide an electrode which is suitable for use in a dilute brine electrolysis at low temperatures and which has good corrosion-resistance.

A further object of this invention is to provide a method for making such an electrode.

Accordingly, one embodiment of this invention provides an electrode for use in electrolysis of an aqueous solution of a metal halide where the electrode comprises:

(1) an electroconductive substrate; and (2) a coating on the substrate, where the coating comprises:

(a) 5 to 75 mole percent of iridium oxide;

(b) 5 to 70 mole percent of at least one metal oxide selected from the group consisting of oxides of titanium, tantalum and niobium; and (c) 20 to 70 mole percent of at least one of a member selected from the group consisting of tin oxide and cobalt oxide, with the sum of the mole percent of the iridium oxide (a) plus the mole percent of the metal oxide (b) being at least 30 mole percent.

In another embodiment, this invention provides a method of making an electrode as described above for use in electrolysis of an aqueous solution of a metal halide, where the method comprises:

(1) applying a solution containing:

(a) an iridium compound;

(b) at least one metal compound selected from the group consisting of compounds of titanium, tantalum and niobium; and (c) at least one of a member selected from the group consisting of a tin compound and a cobalt compound to an electroconductive substrate; and (2) thermally treating the coated electroconductive substrate in an oxidizing atmosphere to form on the electroconductive substrate an oxide coating comprising:
(a) 5 to 75 mole percent of iridium oxide;
(b) 5 to 70 mole percent of at least one metal oxide selected from the group consisting of oxides of titanium, tantalum and niobium; and
(c) 20 to 70 mole percent of at least one of a member selected from the group consisting of tin oxide and cobalt oxide, with the sum of the mole percent of the iridium oxide (a) plus the mole percent of the metal oxide (b) being at least 30 mole percent.

In the figures, 1 shows the value measured for the electrode produced in Example 1; 2 shows the value measured for the electrode produced in Example 2; 3 shows the value measured for the electrode produced in Comparison Example 1; and 4 shows the value measured for the electrode produced in Comparison Example 2.

Figure 1:
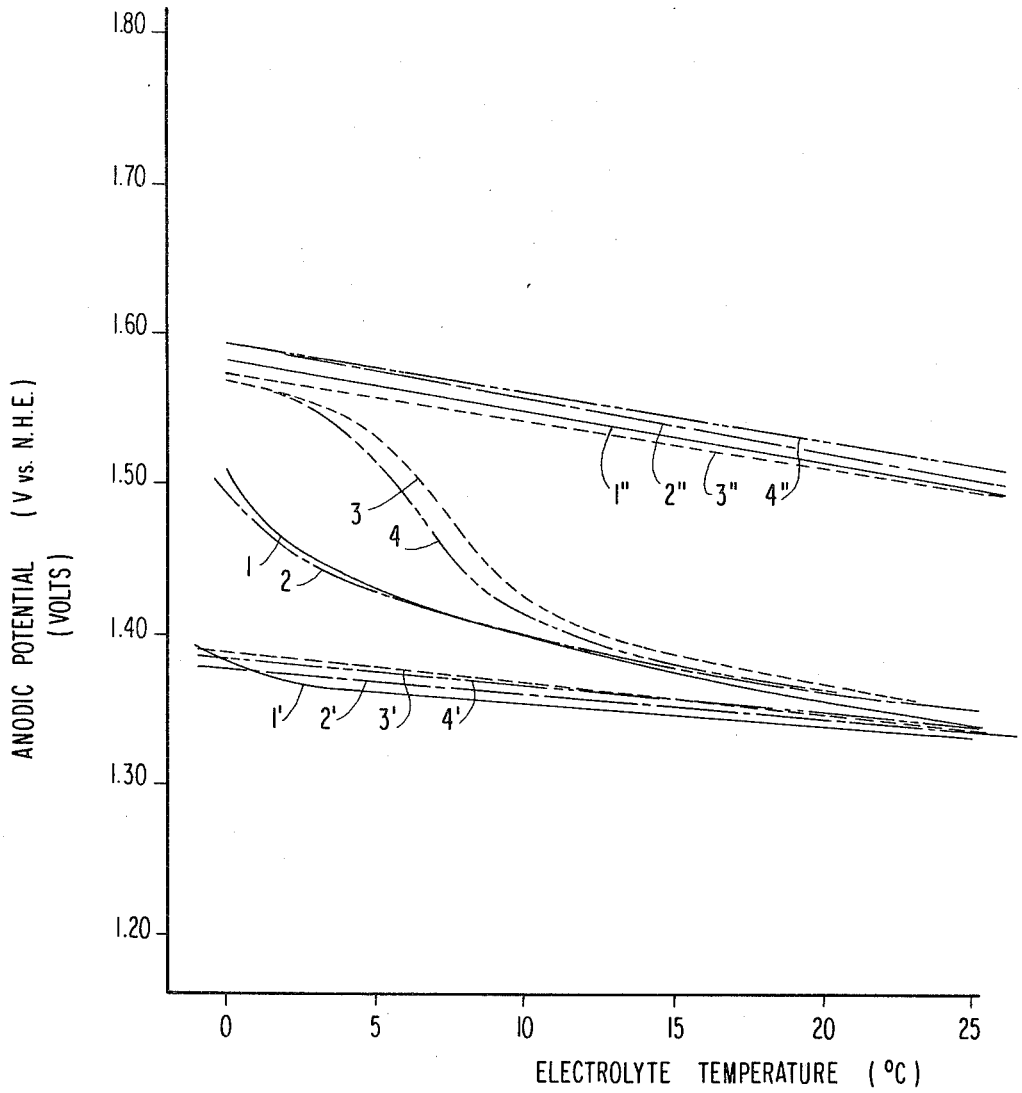
FIG. 1 is a graph showing the relationship between the anodic potential of electrodes produced in the examples and comparison examples given hereinafter and the temperature of the electrolyte.

In FIG. 1, numerals without any prime designation show anodic potentials in dilute brine, numerals with a single prime designation show chlorine evolution potentials in saturated brine and numerals with a double prime designation show oxygen evolution potentials.

DETAILED DESCRIPTION OF THE INVENTION

This invention provides a superior electrode for use in electrolysis which has excellent corrosion-resistance and is capable of maintaining sufficient difference between oxygen and chlorine evolution potential in electrolysis of dilute brine even at low temperatures of below 20° C. No abrupt elevation of the chlorine evolution potential occurs due to the presence in the electrode oxide coating of a platinum group metal, such as iridium, at least one valve metal selected from titanium, tantalum and niobium, and tin and/or cobalt, each of which is present in the amount set forth above in the oxide form.

Thus, by using the electrode of this invention, a sudden elevation of chlorine evolution potential at low electrolysis temperatures, which is observed in using a conventional electrode which is made of mainly ruthenium oxide, does not occur.

Therefore, with the electrode of this invention, remarkable advantages are achieved in the ability to operate the electrolysis in a stable manner for a long period of time under electrolysis conditions where high chlorine evolution efficiency at low operating voltages can be maintained.

In addition to above advantages, the manufacture of the electrode of this invention is easy since the electrode coating does not contain antimony which tends to volatilize the manufacturing process, and also the electrode coating in an oxide state exhibits excellent durability and good adhesion to an electroconductive substrate such as titanium since a stable solid solution of the rutile type is easily formed.

The electroconductive substrate which can be used in the electrode of this invention is not particularly limited, and various known materials and forms can be used. Titanium is the most suitable material for brine electrolysis, but other valve metals such as tantalum, niobium, zirconium, hafnium, etc. and alloys in which these metals predominate, and materials coated with these valve metals on a good electroconductive material (for example, copper, aluminum, etc.) can also be used as the electroconductive substrate. The thickness of the substrate which is employed in the invention is not limited.

Many methods for forming the coating on the electroconductive substrate can be used. A thermal decomposition method where a solution containing thermally decomposable compounds of the coating component metals is applied to an electroconductive substrate with a brush or other coating means can be used. It is preferred for the coating solution to be prepared by dissolving an organic or inorganic metal salt, such as the chlorides, of each coating component metal in solvents such as mineral acids, for example, hydrochloric acid, nitric acid, etc., and alcohols, for example, isopropyl alcohol, n-propyl alcohol, n-butyl alcohol, ethyl alcohol, etc. Also, the thickness of the oxide coating on the substrate is not limited, and generally a thickness of more than about 0.1 micron is suitable.

Suitable iridium compounds which can be used include the chloride, sulfate, nitrate and complex salts of iridium as well as the organic salts thereof. A suitable solution concentration for these compounds can range from about 1 to 10 g/100 ml, preferably 2 to 5 g/100 ml.

Suitable titanium compounds which can be used include the chlorides, the organic salts or complexes of titanium and butyl titanate; suitable tantalum compounds which can be used include the chlorides, the organic salts or complexes of tantalum as well as butyl tantalate; and suitable niobium compounds which can be employed include the chlorides, the organic salts or complexes of niobium. Exemplary tin compounds include stannous and stannic chloride, and exemplary cobalt compounds include cobalt chlorides. The solution concentration of these compounds which can be used is not particularly restricted.

The coated substrate produced as described above is then heat treated in an oxidizing atmosphere to convert the compounds into the oxide form.

In order to oxidize sufficiently these compounds present in the coating to form a firm oxide coating layer, the thermal decomposition is preferably conducted in an oxidizing atmosphere where the oxygen partial pressure is about 0.1 to about 0.5 atm. Usually, heating in air is sufficient for this purpose, but other gas mixtures containing about 10% or more by volume of oxygen are also suitable.

A suitable heating temperature for conversion of the compounds to the oxides is about 350° to about 650° C., preferably 450° to 550° C. The heating time is not restricted, but generally about 2 minutes to about 1 hour, more generally 5 minutes to 20 minutes, is suitable. Simultaneously, with these treatments, the coating is provided with the desired electrochemical activity.

The electrode of this invention produced as described above can be in any form, e.g., known conventional forms such as that of a plate, a rod, a mesh, a screen, a perforated plate, etc., and the electrode can be used in the electrolysis of aqueous solutions of metal halides such as chlorides of alkali metals, e.g., sodium chloride or potassium chloride, and the corresponding bromides and iodides of these alkali metals, as well as of aqueous solutions of alkaline earth metal halides such as those of magnesium and calcium.

The desired total thickness of the coating can be easily obtained by repeating the procedures described above of solution application and heat treatment.

The following examples are given to illustrate the present invention in greater detail. Unless otherwise indicated, all parts, percents, ratios and the like are by weight.

EXAMPLE 1

Iridium chloride containing 1.1 g of iridium, 10 ml of a titanium tri-chloride solution containing 0.5 g of titanium, stannous chloride containing 1.7 g of tin, 5 ml of a 20% hydrochloric acid aqueous solution and 5 ml of isopropyl alcohol were mixed to prepare a coating solution.

A pure titanium plate having a thickness of 3 mm was used after degreasing with acetone and pickling in oxalic acid, as an electroconductive substrate. The coating solution was applied on this substrate with a brush, and after drying at room temperature (about 15°–30° C.), baking was carried out in an electric furnace at 550° C. for 10 minutes while forcing air through the furnace.

After repeating these treatments of coating and baking in the same manner 20 times, the coated substrate was further heated at 550° C. for 1 hour and, thus, an electrode was produced.

The composition of the coating of the electrode obtained was 18.7 mole percent of iridium oxide, 34.3 mole percent of titanium oxide and 47.0 mole percent of tin oxide, and the thickness of the coating was about 2μ.

EXAMPLE 2

Iridium chloride containing 0.55 g of iridium, 10 ml of a hydrochloric acid aqueous solution of tantalum pentachloride containing 1.5 g of tantalum, stannous chloride containing 0.55 g of tin, cobalt chloride containing 0.14 g of cobalt and 5 ml of butyl alcohol were mixed to prepare a coating solution.

This solution was applied with a brush to a titanium substrate pretreated as described in Example 1, and after drying at room temperature, baking was carried out in an electric furnace at 500° C. for 10 minutes, through which a mixed gas of oxygen:nitrogen in a volume ratio of 30:70 was passed. These procedures were repeated 20 times, and a heating treatment was further carried out at 550° C. for 1 hour. Thus, an electrode was produced.

The composition of the coating of the electrode obtained was 15.7 mole percent of iridium oxide, 45.7 mole percent of tantalum oxide, 25.5 mole percent of tin oxide and 13.1 mole percent of cobalt oxide, and the thickness of the coating was about 2μ.

COMPARISON EXAMPLE 1

Ruthenium chloride containing 0.5 g of ruthenium, 1 ml of a 36% hydrochloric acid aqueous solution and 4.5 ml of isopropyl alcohol were mixed to prepare a coating solution. This solution was applied to a titanium substrate in the same manner as described in Example 1 with a brush. After drying at room temperature, baking was carried out in an electric furnace at 500° C. for 5 minutes while passing air through the furnace. After repeating these procedures 10 times, an electrode having a coating of ruthenium oxide of a thickness of about 2μ was produced.

COMPARISON EXAMPLE 2

Ruthenium chloride containing 0.5 g of ruthenium, 1.5 ml of butyltitanate, 0.2 ml of a 36% hydrochloric acid aqueous solution and 3.1 ml of butyl alcohol were mixed to prepare a coating solution. An electrode having a coating of a ruthenium oxide-titanium oxide solution of a thickness of about 2μ was produced using the same procedure as described in Example 1.

The characteristics of the electrodes of this invention and conventional comparison electrodes are shown below.

The chlorine evolution potential, the oxygen evolution potential and the anodic potential in a 30 g/l dilute NaCl aqueous solution were measured at various liquid temperatures for the electrodes produced in Example 1, Example 2, Comparison Example 1 and Comparison Example 2.

The chlorine evolution potential was measured in a saturated NaCl aqueous solution, and the oxygen evolution potential was measured in a 100 g/l sodium sulfate aqueous solution (pH=7).

FIG. 1 shows the relationship between the value of the anodic potential versus a normal hydrogen electrode (NHE) measured at 15 A/dm$^2$ and the temperature.

From the results presented in FIG. 1, it can be clearly seen that the chlorine evolution potentials of each electrode in a saturated sodium chloride aqueous solution (1', 2', 3', 4') and the oxygen evolution potentials of each electrode (1'', 2'', 3'', 4'') are not greatly different from each other. However, it can be seen that for the anodic potentials of each electrode in dilute brine (1, 2, 3, 4), the anodic potentials of both of the electrodes produced in Comparison Example 1 and Comparison Example 2 increase suddenly at lower than 15° C. so that their chlorine evolution potentials approach their oxygen evolution potentials, and oxygen evolution progresses at a very rapid rate.

On the other hand, it can be seen that as to the anodic potentials of the electrodes produced in Examples 1 and 2, the chlorine evolution potentials gradually begin to approach the oxygen evolution potential only at lower than 5° C., and within the range of 5°–20° C., the chlorine evolution reaction is the main reaction. Accordingly, chlorine is evolved and hypochlorite is obtained at good efficiency.

Figure 2:
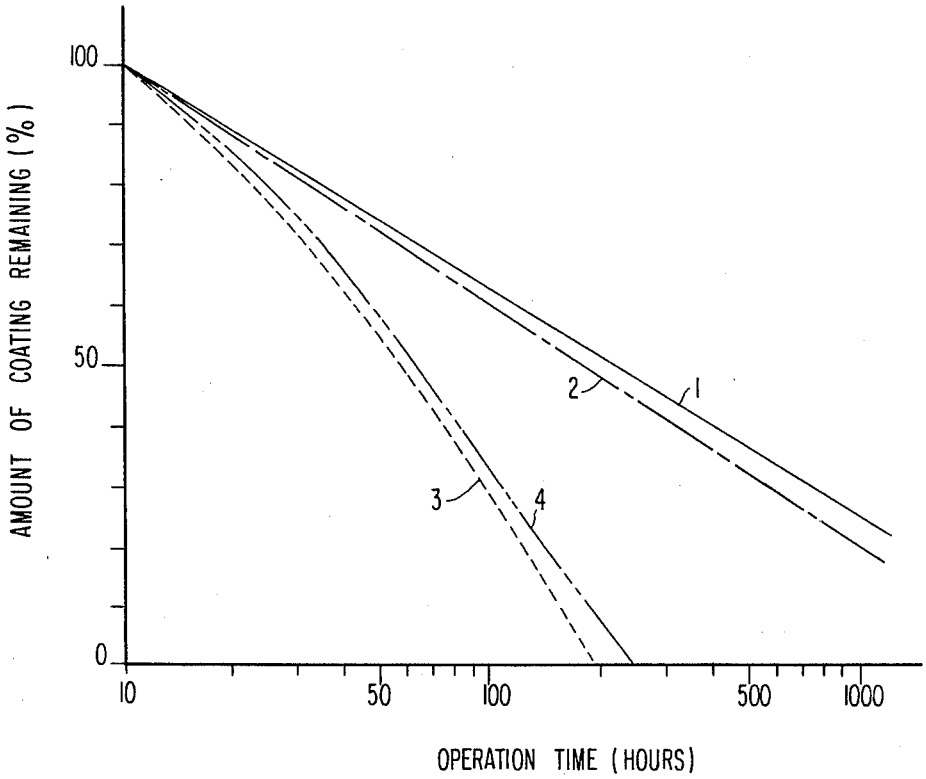
FIG. 2 is a graph showing the amount of electrode coating remaining for electrodes produced in the examples and comparison examples given hereinafter after use in electrolysis.

Furthermore, in order to demonstrate the durability of these electrodes at low temperature, electrolytic tests were carried out in a 30 g/l dilute sodium chloride aqueous solution at 5° C. at 30 A/dm$^2$. The degree of wear of the coating or amount of coating remaining was measured against electrolytic operation time, and the result obtained is shown in FIG. 2. The initial thicknesses of each electrode coating was 2μ, and the value shown in FIG. 2 is in terms of the percent of the coating remaining to the amount of the coating initially present. From the results in FIG. 2, it is clear that the coating of each comparison electrode was consumed and lost on electrolysis for 100–200 hours, and these electrodes were passivated. However, both electrodes produced in Examples 1 and 2 of this invention survived the electrolysis for longer than 1000 hours. This proved that the electrodes according to this invention had good corrosion resistance for use in dilute brine electrolysis at low temperatures.

EXAMPLE 3

Electrodes with various coating compositions according to this invention were produced using the procedures described in Example 1. The compositions of the coating of these electrodes are shown in Table 1 below.

TABLE 1

COMPOSITIONS OF COATING OF EXAMPLE 3 (mole percent)

| Electrode No. | Iridium Oxide | Titanium Oxide | Tantalum Oxide | Niobium Oxide | Tin Oxide | Cobalt Oxide |
|---|---|---|---|---|---|---|
| 1 | 15.4 | 61.0 | — | — | 23.6 | — |
| 2 | 70.6 | 6.8 | — | — | 22.6 | — |
| 3 | 13.4 | 53.9 | — | — | 21.7 | 11.0 |
| 4 | 16.0 | 32.1 | — | — | 38.8 | 13.1 |
| 5 | 7.7 | 27.8 | — | — | 50.1 | 14.4 |
| 6 | 34.7 | — | 9.2 | — | 56.1 | — |
| 7 | 23.6 | — | 19.2 | — | 57.2 | — |
| 8 | 25.2 | — | 13.4 | — | 61.4 | — |
| 9 | 32.1 | — | — | 15.7 | 52.2 | — |
| 10 | 52.3 | 6.0 | 12.1 | — | 29.6 | — |

The characteristics of these electrodes were evaluated using the same methods as stated before, and it was found that these electrodes had the same excellent electrolytic characteristics in dilute brine at low temperature and good corrosion resistance as those of Examples 1 and 2.

This confirmed that the electrodes of this invention are excellent and are advantageous for use in electrolysis of dilute brine at low temperature.

While the invention has been described in detail and with respect to specific embodiments thereof, it will be apparent to one skilled in the art that various changes and modifications can be made therein without departing from the spirit and scope thereof.

What is claimed is:

1. An electrode for use in electrolysis of an aqueous solution of a metal halide comprising:

(a) an electroconductive substrate; and (b) a coating on said substrate, said coating consisting essentially of:

(i) 5 to 75 mole percent of iridium oxide;

(ii) 5 to 70 mole percent of at least one metal oxide selected from the group consisting of oxides of titanium, tantalum and niobium, and (iii) 20 to 70 mole percent of at least one of a member selected from the group consisting of tin oxide and cobalt oxide, with the sum of the mole percent of the iridium oxide (i) plus the mole percent of the metal oxide (ii) being at least 30 mole percent.

2. The electrode according to claim 1, wherein said coating (b) comprises:

(i) 5 to 75 mole percent of iridium oxide;

(ii) 5 to 70 mole percent of titanium oxide; and (iii) 20 to 70 mole percent of tin oxide.

3. The electrode according to claim 2, wherein said coating (b) consists essentially of said components (i), (ii) and (iii).

4. The electrode according to claim 1, wherein the electroconductive substrate is a substrate of titanium, tantalum, niobium, zirconium or hafnium or an alloy consisting predominantly of titanium, tantalum, niobium, zirconium or hafnium.

5. A method of making an electrode for use in electrolysis of an aqueous solution of a metal halide which comprises:

(a) applying a solution containing:

(i) an iridium compound;

(ii) at least one metal compound selected from the group consisting of compounds of titanium, tantalum and niobium; and (iii) at least one of a member selected from the group consisting of a tin compound and a cobalt compound to an electroconductive substrate; and (b) thermally treating said coated electroconductive substrate in an oxidizing atmosphere to form on the electroconductive substrate an oxide coating consisting essentially of (i) 5 to 75 mole percent of iridium oxide;

(ii) 5 to 70 mole percent of at least one metal oxide selected from the group consisting of oxides of titanium, tantalum and niobium; and (iii) 20 to 70 mole percent of at least one of a member selected from the group consisting of tin oxide and cobalt oxide, with the sum of the mole percent of the iridium oxide (i) plus the mole percent of the metal oxide (ii) being at least 30 mole percent.

6. The method of making an electrode according to claim 5, wherein said compounds (i), (ii) and (iii) in said solution are chlorides.

7. The method of making an electrode according to claim 5 or 6, wherein the thermal treatment is conducted in an oxidizing atmosphere in which the oxygen partial pressure is about 0.1 to about 0.5 atm.

8. The method of making an electrode according to claim 5 or 6, wherein the thermal treating is at a temperature of about 350 to about 650° C.

9. The method of making an electrode according to claim 7, wherein the thermal treating is at a temperature of about 350° to about 650° C.

* * * * *